United States Patent [19]

Lehmann et al.

[11] Patent Number: 4,817,209

[45] Date of Patent: Apr. 4, 1989

[54] CHILD'S BASEBALL GLOVE

[76] Inventors: Roger W. Lehmann, 18 Flintlock Ct., Bernardsville, N.J. 07924; Michael I. Satten, 4 Farmers Rd., Kingspoint, N.Y. 11024

[21] Appl. No.: 223,291

[22] Filed: Jul. 22, 1988

[51] Int. Cl.[4] ..... A41D 13/10

[52] U.S. Cl. ..... 2/19

[58] Field of Search ..... 2/16, 19, 160, 161 A

[56] References Cited

U.S. PATENT DOCUMENTS

| | | | |
|---|---|---|---|
| 899,522 | 9/1908 | Gamble | 2/19 |
| 958,117 | 8/1908 | Hartman | 2/19 |
| 1,072,012 | 9/1913 | King | 2/19 |

*Primary Examiner*—Werner H. Schroeder
*Assistant Examiner*—Sara Current
*Attorney, Agent, or Firm*—Salter & Michaelson

[57] ABSTRACT

A child's baseball glove includes a hand member including a palm section, a finger section, a thumb section, and a webbing section connecting the thumb section to the finger section, and a padded pocket member which extends along the front side of the thumb section, across the base portion of the palm section, along the front side of the outer portion of the finger section and across the upper end portion of the front side of the finger section to substantially define the perimeter of a pocket in the glove. The glove preferably further includes an elongated padded retainer member which is detachably secured to opposite side portions of the pocket member and extends in outwardly spaced relation across the base portion of the palm section. The glove can be initially used by a young child with the retainer member in place in order to enable the child to more easily catch and retain a ball in the pocket of the glove, and after the child has developed an initial level of proficiency at utilizing the glove, the retaining member can be removed to enable the glove to be used in a manner similar to a conventional baseball glove.

14 Claims, 4 Drawing Sheets

CHILD'S BASEBALL GLOVE

BACKGROUND AND SUMMARY OF THE INVENTION

The instant invention relates to athletic equipment for children, and more particularly to a baseball glove which is adapted for use by a young child.

The sport of baseball has been found to be extremely popular with members of virtually all age groups, including relative young children. However, it has been found that in many instances young children are unable to actively participate in either the sport of baseball or in baseball-related activities, such as games of "catch", due to their general lack of coordination and manual dexterity. Further, it has been found that the heretofore available baseball gloves have generally not been adapted to better enable young children to participate in baseball related activities. Hence, there is a need for a baseball glove construction which is effectively adapted to enable young children to participate in baseball related activities, such as games of catch.

Baseball gloves representing the closest prior art to the subject invention of which the applicant is aware are disclosed in the KING U.S. Pat. Nos. 962,438; CLINE, 1,003,031; KING, 1,072,012; LE MAT, 2,200,204; OLIVER et al, 2,510,246; WELLS, JR., 2,902,693; and MUCHNICK, 3,953,030. However, while these references disclose a variety of different types of baseball gloves, they generally fail to address the need for a baseball glove which is effectively adapted for use by young children; and hence they are believed to be of only general interest with respect to the subject invention.

The instant invention provides an effective baseball glove construction which is adapted to enable a young child to more easily catch a ball, such as a relatively soft, child's baseball. Specifically, the instant invention provides a baseball glove comprising a hand member which is preferably made in a fabric-covered, padded construction and comprises a palm section, a thumb section, a finger section, including a plurality of connected side-by-side finger elements, and a webbing section connecting the thumb section to the next adjacent finger element. The baseball glove further comprises a pocket member which is preferably made in a fabric-covered, padded construction and extends from a point adjacent the outer extremity of the thumb section, downwardly along the front side of the thumb section, across the base portion of the palm section, upwardly along the front side of the outermost finger element, and across the front sides of the finger elements adjacent the outer extremities thereof to a point adjacent the webbing section. At least those portions of the pocket member which extend downwardly along the front side of the thumb section, across the base portion of the palm section, and upwardly along the front side of the outermost finger element, have an average cross-sectional diameter of at least approximately one inch, and the pocket member preferably has an average cross-sectional diameter of at least approximately one inch along its entire extent; although the pocket member preferably tapers in its extent across the finger elements. The baseball glove preferably further comprises a retaining member which extends in forwardly spaced relation to the palm section between the portion of the pocket member which extends along the front side of the thumb section and the portion of the pocket member which extends along the front side of the outermost finger element. The retaining member is preferably also made in a fabric-covered, padded construction, and it is preferably detachably secured to the retaining member. Further, the pocket member preferably includes the hook portions of a pair of hook-and-pile type fastening assemblies which are engageable with the pile fabric of the pocket member to detachably secure the retaining member thereon. The retaining member preferably also has an average diameter of at least approximately one inch, and it is preferably also of fabric-covered, padded construction. The hand member is preferably adapted for receiving a normal adult-size hand therein so that the thumb and fingers of the hand are received in the thumb and finger sections, respectively, of the hand member. However, the hand member preferably further comprises an inner fabric or leather positioning member which defines a reduced mitten-shaped area behind the palm section so that the glove can be alternatively worn by a child with the child's hand positioned behind the palm section.

It has been found that the baseball glove of the subject invention can be effectively utilized by a young child for playing baseball related games of catch. In this regard, it has been found that the pocket member effectively forms a permanent pocket in the glove so that a young child can more easily catch and retain a ball therein. Further, the retaining member is operative for partially enclosing the lower portion of the pocket formed by the pocket member in order to further enable a young child to easily catch and retain a ball in the glove. However, because the retaining member is detachably secured to the pocket member, the baseball glove can be initially used by a young child with the retaining member in place and; thereafter, when the child has developed a certain level of skill at utilizing the glove, the retaining member can be removed so that the glove can be utilized in a manner similar to a conventional baseball glove.

Accordingly, it is a primary object of the instant invention to provide an effective baseball glove which is adapted for use by a relatively young child.

Another object of the instant invention is to provide a baseball glove having a retaining member thereon to enable the glove to be more effectively utilized by a young child.

Another object of the instant invention is to provide a baseball glove having a detachable retaining member thereon.

An even further object of the instant invention is to provide a baseball glove comprising a pocket member which is operative for forming a permanent pocket in the glove, and a detachable retaining member which is operative for enclosing the lower portion of the pocket in order to more effectively retain a ball therein.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE DRAWINGS

Figure 1:
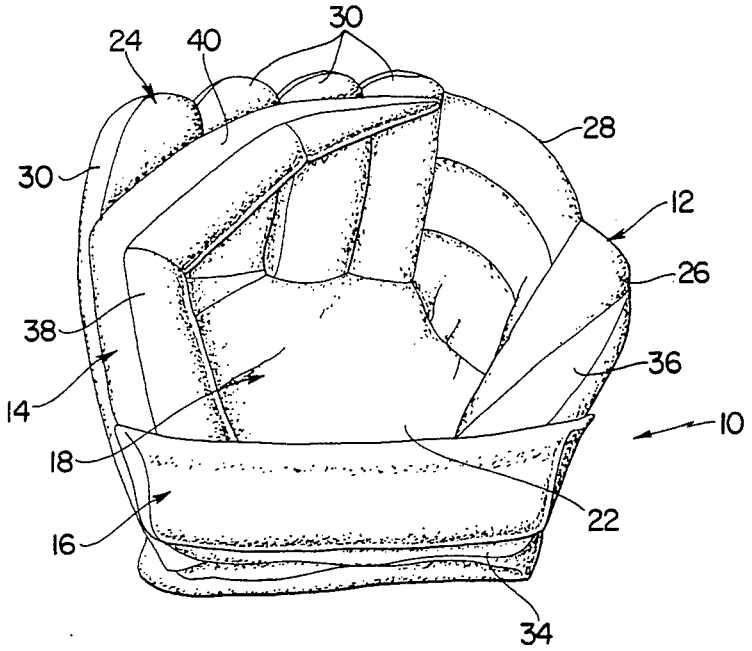
FIG. 1 is a front view of the baseball glove of the subject invention.
Figure 2:
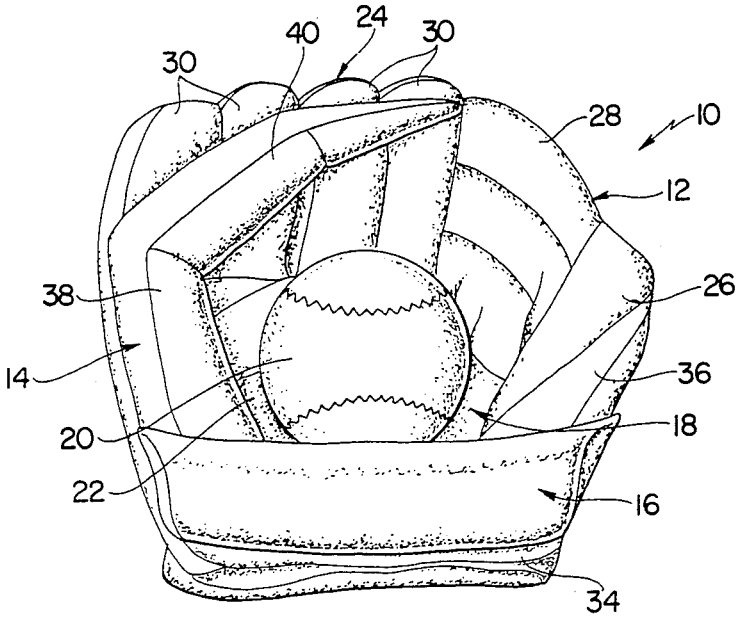
FIG. 2 is a similar view with a ball received in the pocket in the glove.

Referring now to the drawings, the baseball glove of the instant invention is illustrated in FIGS. 1–4 and generally indicated at 10. The baseball glove 10 comprises a glove member generally indicated at 12, a pocket member generally indicated at 14, and a retaining member generally indicated at 16. As illustrated, the pocket member 14 is permanently secured to the glove member 12 so that it cooperates therewith to define a pocket generally indicated at 18 for receiving a ball 20 in the glove 10, and the retaining member 16 is detachably secured to the pocket member 14 so that it partially encloses the lower portion of the pocket 18 in order to more effectively retain the ball 20 after it has been received in the pocket 18.

Figure 3:
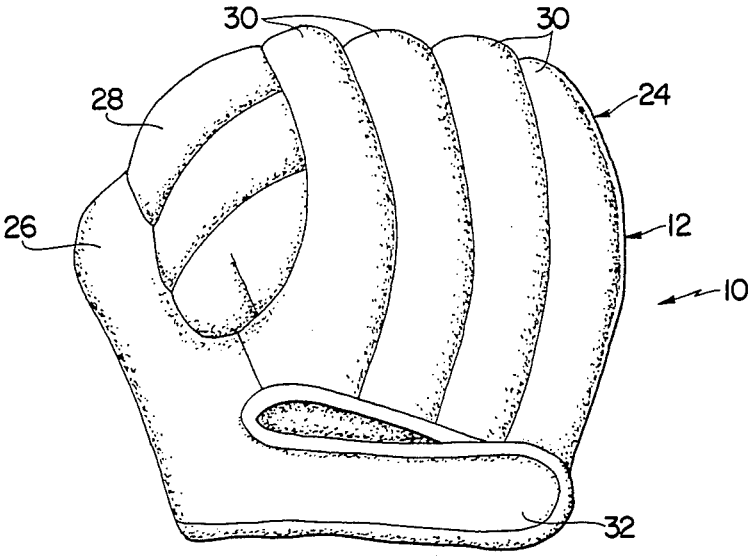
FIG. 3 is a rear view of the glove.
Figure 4:
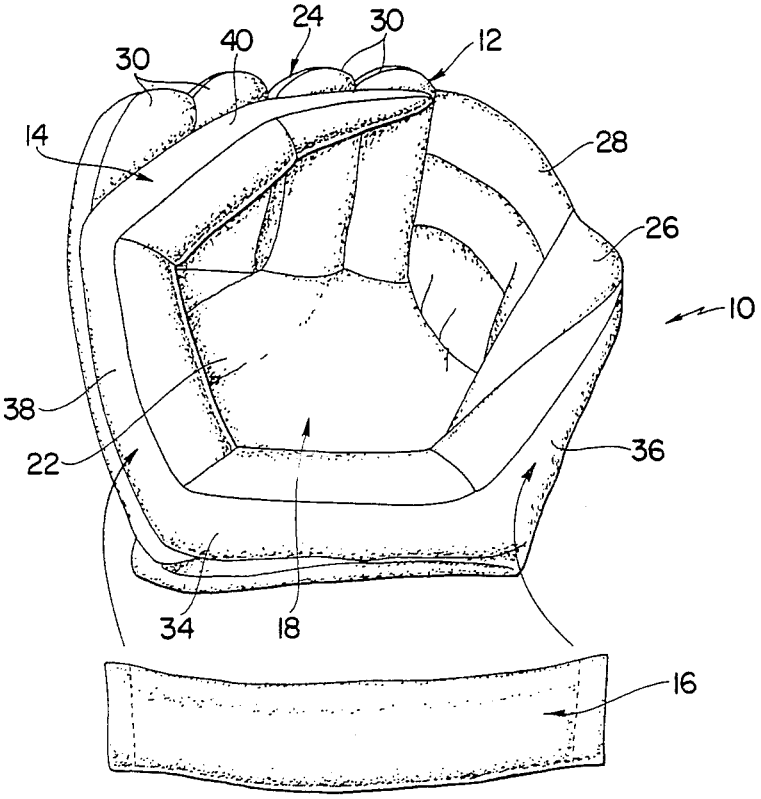
FIG. 4 is a front view of the glove with the retaining member in a detached position.
Figure 5:
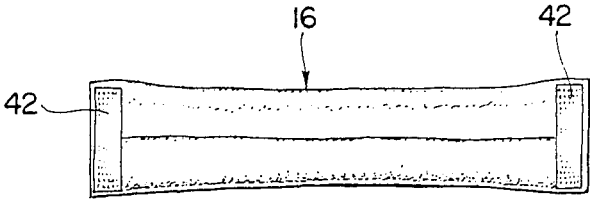
FIG. 5 is a rear view of the retaining member.
Figure 6:
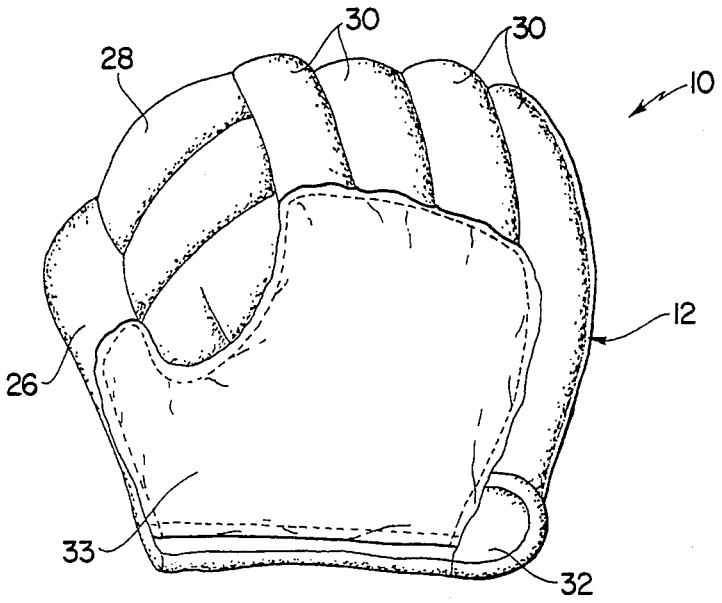
FIG. 6 is a rear view of the glove with portions broken away to illustrate the inner positioning member.

The glove member 12 is preferably made in a relatively soft, padded construction, and it preferably includes a soft pile fabric outer covering. The glove member 12 comprises a palm section 22, a finger section 24, a thumb section 26, and a webbing section 28. The finger section 24 includes a plurality of connected finger elements 30 which extend outwardly from the palm section 22, and the thumb section 26 also extends outwardly from the palm section 22. The webbing section 28 extends between the thumb section 26 and the next adjacent finger element 30 in a manner similar to the webbing section of a conventional baseball glove. As illustrated in FIG. 3, the glove member 12 further includes a rear retainer strap 32 which is also similar to the retainer strap of a conventional baseball glove. The glove member 12 is preferably adapted to receive an adult-size hand with the thumb and fingers of the hand positioned in the thumb section 26 and the finger section 24, respectively. However, the glove member 12 preferably includes an inner fabric lining 33 which defines a relatively small mitten-shaped area behind the palm section 22 for alternatively receiving the hand of a child so that it is positioned behind the palm section 22. The fabric lining 33 is preferably adapted for receiving a hand which is approximately one-half the size of an adult's hand, i.e., a hand which is large enough so that it is receivable in the thumb and finger sections 26 and 24, respectively, in a normal manner. Further, it will be understood that other embodiments of the baseball glove of the subject invention wherein the glove member is adapted to resemble other types of baseball gloves, such as a first baseman's glove or a catcher's glove, are contemplated.

The pocket member 14 is preferably also made in a relatively soft, heavily padded construction, and it preferably also includes a relatively soft pile fabric outer covering. The pocket member 14 is permanently attached to the glove member 12, and it includes a heavily padded base portion which extends across the base portion of the palm section 22, an outwardly tapered thumb portion 36 which extends outwardly along the front side of the thumb section 26, a side portion 38 which extends outwardly along the front side of the outermost or end finger element 30, and a tapered end portion 40 which extends across the front sides of the finger elements 30 adjacent the outer ends thereof to a point adjacent the webbing section 28. The base portion 34 and the side portion 38 preferably have cross-sectional diameters of at least approximately one inch, and the overall pocket section 14 preferably has an average cross-sectional diameter of at least approximately one inch.

The retaining member 16 is preferably also of relatively soft, heavily padded construction and includes a soft pile fabric outer covering. The retaining element 16 is of generally elongated configuration, and it includes a pair of fastening elements 42 which are positioned adjacent opposite ends thereof. The fastening elements 42 preferably comprise the hook portions of hook-and-pile type fastening assemblies, such as Velcro (Velcro U.S.A. TM) fastening assemblies, and they are engageable with the fabric on the pocket member 14 for detachably securing the retaining member 16 in the assembled position illustrated in FIGS. 1 and 2. In this regard, as will be seen, when the retaining member 16 is in the assembled position thereof, it extends between the thumb portion 36 and the side portion 38 of the retaining member 14 in forwardly spaced relation to the palm section 22 so that it partially encloses the lower portion of the pocket 18.

The ball 20 preferably comprises a soft, padded, fabric-covered ball, which is preferably adapted to appear as a conventional baseball.

In use, the baseball glove 10 is positioned on the appropriate hand of a user; and thereafter, the glove 10 can be utilized for catching a ball, such as the ball 20, in the pocket 18. In this connection, when the glove 10 is worn by a person having a normal adult-size hand, the glove is worn in a normal manner with the thumb and fingers located in the thumb and finger sections 26 and 24, respectively, but when it is worn by a child, the child's hand is positioned in the mitten-shaped area defined by the lining 33. When the glove 10 is utilized with the retaining member 16 assembled on the pocket member 14 in the manner illustrated in FIGS. 1 and 2, the retaining member 16 extends across the lower portion of the pocket 18 to enable a child to more easily retain the ball 20 in the pocket 18. However, because the retaining member 16 is detachably secured to the pocket member 14, it can be removed from the pocket member 14 after the child has become adept at catching the ball 20 in the glove 10; and thereafter the glove member 12 with the pocket member 14 thereon can be utilized in a manner similar to a conventional baseball glove for catching the ball 20. In this regard, even after the retaining member 16 has been removed from the pocket member 14, the pocket member 14 cooperates with the glove member 12 to form an effective pocket so that the child can, in most cases, easily catch and retain the ball 20.

It is seen therefore that the instant invention provides an effective baseball glove which is adapted for use by a young child. The glove 10 can be effectively utilized with the retaining member 16 assembled on the pocket member 14 to enable a young child to gain an initial level of skill, and thereafter the retaining member 16 can be removed from the pocket member 14 to permit the glove member 12 with the pocket member 14 thereon to be utilized in a manner similar to a conventional baseball glove. Accordingly, it is seen that the baseball glove of the instant invention has a relatively high level of play value, and that it represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A child's baseball glove comprising a hand member including a palm section, a thumb section, a finger section including a plurality of side-by-side finger elements, and a webbing section, said finger elements being connected to one another adjacent the outer ends thereof, said webbing section connecting said thumb section to the next adjacent finger element, and a pocket member, said pocket member being of fabric-covered, padded construction and extending from a point adjacent the outer extremity of said thumb section downwardly along the front side of said thumb section, across the base portion of said palm section, upwardly along the front side of the outermost finger element and across the front sides of said finger elements adjacent the outer extremities thereof to a point adjacent said webbing section, at least those portions of said pocket member which extend downwardly along the front side of said thumb section across the base portion of said palm section and upwardly along the front side of the outermost finger element having an average cross-sectional diameter of at least approximately one inch.

2. In the child's baseball glove of claim 1, said pocket member having an average cross-sectional diameter of at least approximately one inch but tapering in its extent across said finger elements.

3. The child's baseball glove of claim 1 further comprising a retaining member extending between the portion of the pocket member which extends downwardly along the front side of said thumb section and the portion of said pocket member which extends upwardly along the front side of said outermost finger element in forwardly spaced relation to said palm section.

4. In the child's baseball glove of claim 3, said retaining member being of fabric-covered padded construction.

5. In the child's baseball glove of claim 4, said retaining member being detachably secured to said pocket member.

6. In the child's baseball glove of claim 3, said pocket member having a pile fabric outer covering, said retaining member including the hook portion of a hook-and-pile type fastening assembly, said hook portion being engageable with the pile fabric of said pocket member to detachably secure said retaining member thereon.

7. In the child's baseball glove of claim 3, said retaining member being of elongated configuration and having an average diameter of at least approximatley one inch.

8. A child's baseball glove comprising a hand member including a palm section, a thumb section, a finger section including at least one finger element, and a webbing section, said webbing section connecting said finger section to said thumb section, and a retaining member detachably secured in a position wherein it extends from a point adjacent the outer side edge of said finger section to a point adjacent the outer side edge of said thumb section in outwardly spaced relation to the lower portion of said palm section.

9. In the child's baseball glove of claim 8, said retaining member being of elongated configuration and having an average cross-sectional diameter of at least approximately one inch.

10. In the child's baseball glove of claim 7, said retaining member being of fabric-covered, padded construction.

11. In the child's baseball glove of claim 1, said hand member being adapted for receiving an adult-size hand therein so that the thumb of said hand is positioned in said thumb section and the fingers of said hand are positioned in said finger section, said hand member further comprising a reduced inner hand positioning member for alternatively positioning a child-size hand which is approximately one-half the size of said adult size hand behind said palm section.

12. In the child's baseball glove of claim 11, said inner hand positioning member defining a mitten-shaped area for receiving said child-size hand.

13. In the child's baseball glove of claim 8, said hand member being adapted for receiving an adult-size hand therein so that the thumb of said hand is positioned in said thumb section and the fingers of said hand are positioned in said finger section, said hand member further comprising a reduced inner hand positioning member for alternatively positioning a child-size hand which is approximately one-half the size of said adult size hand behind said palm section.

14. In the child's baseball glove of claim 13, said inner hand positioning member defining a mitten-shaped area for receiving said child-size hand.

* * * * *